US006210178B1

(12) United States Patent
DeForest, Jr.

(10) Patent No.: US 6,210,178 B1
(45) Date of Patent: Apr. 3, 2001

(54) EXTENDER CARD

(75) Inventor: Robert Duke DeForest, Jr., S. Jordan, UT (US)

(73) Assignee: Pen Cabling Technologies LLC, Salt Lake City, UT (US)

( * ) Notice: Subject to any disclaimer, the term of this patent is extended or adjusted under 35 U.S.C. 154(b) by 0 days.

(21) Appl. No.: 09/293,184

(22) Filed: Apr. 16, 1999

(51) Int. Cl.[7] ..... H01R 12/00
(52) U.S. Cl. ..... 439/76.1; 439/946
(58) Field of Search ..... 439/76.1, 464, 439/471, 64, 946.2, 77, 493, 610; 361/737

(56) References Cited

U.S. PATENT DOCUMENTS

| | | | | |
|---|---|---|---|---|
| 4,798,946 | * | 1/1989 | Fujii et al. | 235/492 |
| 4,842,549 | * | 6/1989 | Asick et al. | 439/464 |
| 5,667,390 | * | 9/1997 | Keng | 439/76.1 |
| 5,715,594 | | 2/1998 | Patterson et al. | 29/842 |
| 5,755,586 | | 5/1998 | Knighton et al. | 439/328 |
| 5,797,771 | | 8/1998 | Garside | 439/607 |
| 5,847,932 | | 12/1998 | Kantner | 361/737 |
| 5,867,406 | | 2/1999 | Yanagisawa | 364/708.1 |
| 5,873,000 | | 2/1999 | Lin et al. | 395/892 |
| 5,875,094 | | 2/1999 | Kirkendoll | 361/686 |
| 5,876,218 | | 3/1999 | Liebenow et al. | 439/74 |
| 5,883,333 | | 3/1999 | Wambeke et al. | 134/92 |
| 5,884,102 | | 3/1999 | England et al. | 395/882 |
| 5,964,595 | * | 10/1999 | Centofante | 439/76.1 |

* cited by examiner

*Primary Examiner*—Brian Sircus
*Assistant Examiner*—T. C. Patel
(74) *Attorney, Agent, or Firm*—Killworth, Gottman, Hagan & Schaeff LLP

(57) ABSTRACT

An extender card is formed from first and second plastic clamshell halves which are intermated with one another and ultrasonically welded together. The first clamshell half is sized to be received within an outer periphery of the second clamshell so that, once welded, the resulting extender card housing body is strong and attractive in that the weld is internal and hidden from view. A cable tie is secured to a cable extending from the extender card and received within a collar of the extender card housing body to provide strain relief for the cable. One or more apertures are formed through the extender card housing body to allow access to a PCMCIA card or PC card installed adjacent to the extender card, for example, to a modular jack receiving structure of a PC modem or network card.

29 Claims, 6 Drawing Sheets

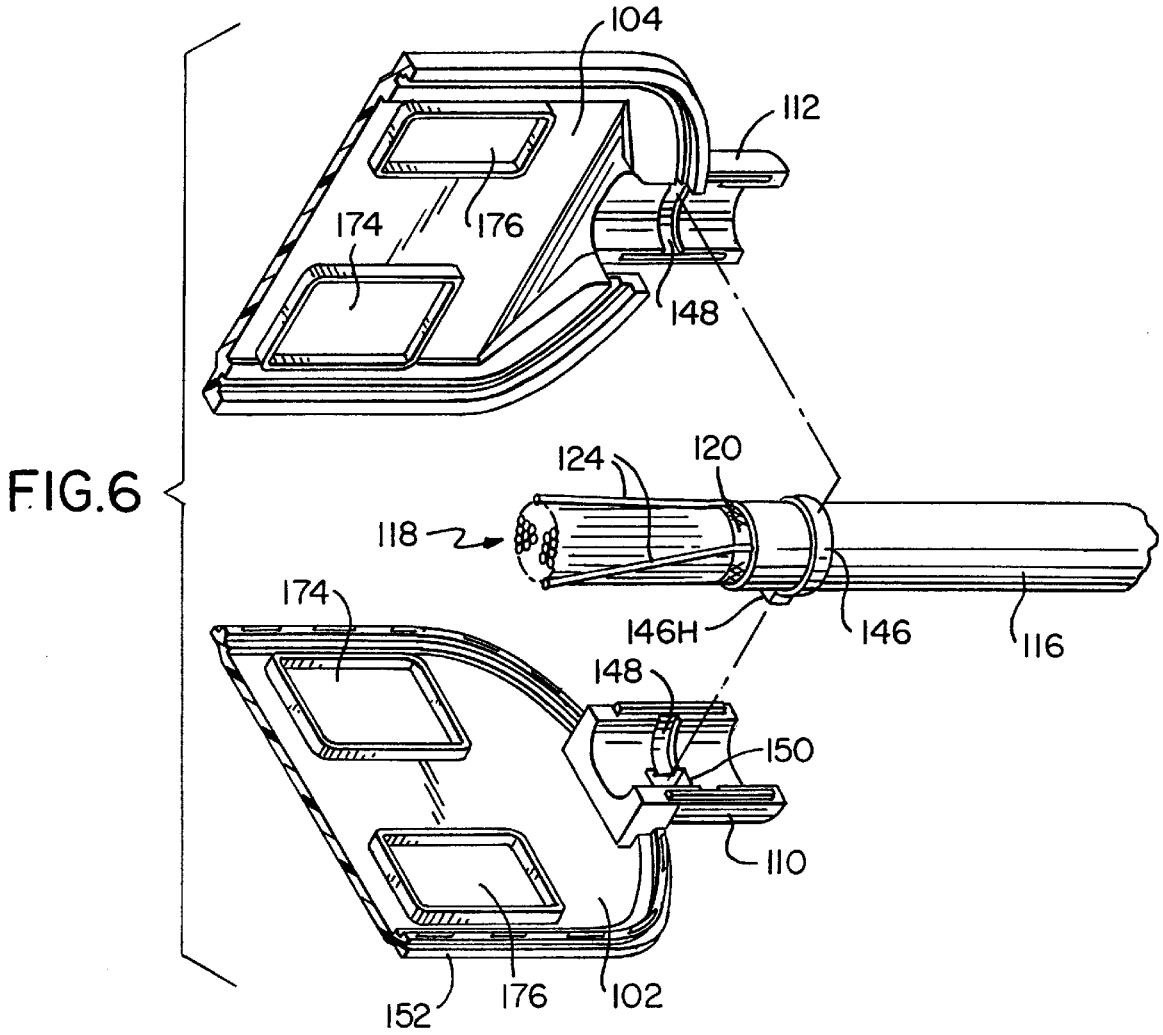
FIG.6
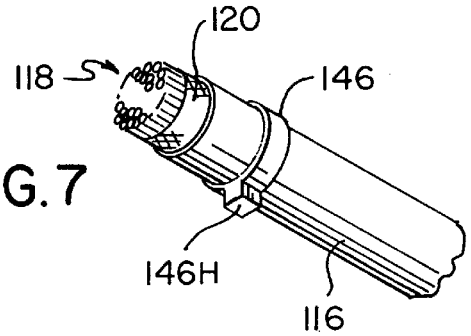
FIG.7
FIG.8
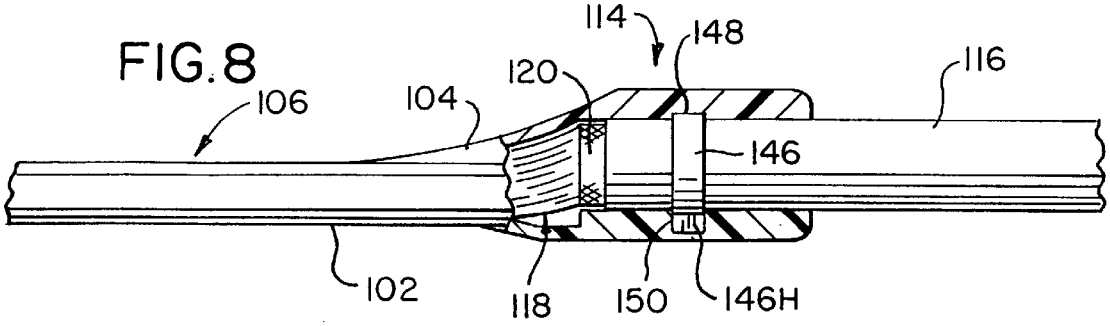

104
164
154
158
162
152
160
102

W
156
104
102

W
156
104
102

112
148
168
168
104B
104
158
154
176
154
174
158
128
158
158
11
11
154
154
104A 110
150
148
102B
166
166
102
162
160
160
152
174
176
126
162
160
152
11
11
162
102A

EXTENDER CARD

BACKGROUND OF THE INVENTION

The present invention relates in general to computers and, more particularly, to an extender card for use with computers. While the present invention is generally applicable to extender cards for computers, it will be described herein with reference to a PCMCIA (Personal Computer Memory Card International Association) extender card which provides access to a laptop computer having a PCMCIA slot for port replication through the PCMCIA slot.

Unlike desktop computers, laptop computers are made to be readily portable. To facilitate portability, laptops include limiting characteristics which are tolerated when traveling. Such characteristics include smaller screens, smaller keyboards, less useful pointing devices, printers which while portable are limited in capability, and the like. Since these limiting characteristics are not tolerated when one is at a home location, oftentimes users have a desktop computer at a home location and a laptop for travel.

To get around laptop limitations and eliminate computer duplication, full sized peripherals can be purchased and connected to a laptop so that the laptop functions as the processor at a home location but is accessed via a conventional keyboard, uses conventional pointing devices, uses a standard sized monitor, has access to more conventional printers, and the like. One means of connecting full sized peripherals to a laptop computer is a docking station to which the laptop is connected for use of the full sized/capability peripherals. Another means of connecting full sized/capability peripherals to a laptop computer is a port replicator. Unfortunately, most docking stations and port replicators are compatible with only a single make and model of laptop computer. And for many laptop computers, no docking stations or port replicators are available from the manufacturer at all.

To accommodate users of such laptop computers and in the interest of making access to full sized peripherals universally available to laptop users regardless of the makes or models of their laptops, universal port replicators are now commercially available. For example, an attractive universal port replicator is available from CNF, Inc. under the name "theBUS". This port replicator connects into a laptop or other computer via an available Type II PCMCIA slot using an extender card which has a first end sized to be received within the slot and connect to the internal PCMCIA connector and a second end which extends beyond the outer surface of the computer and has a cable extending therefrom to "theBUS".

To make such port replicators reliable, the extender cards which connect the port extenders to the computers must be strong to avoid breakage as they extend beyond the outside of computers. Preferably, the extender cards are also inexpensive to reduce the overall cost of the port replicators. Since the extender card occupies only one Type II PCMCIA slot, it would be desirable to enable a person using the port replicator to also use another PCMCIA card or PC card in another available PCMCIA slot immediately adjacent the one occupied by the extender card. For example, the user may have a network or modem PCMCIA card in the laptop and want to use that card for communications when traveling and when at a home location.

Accordingly, there is a need in the art for an improved extender card which can be used for connecting a laptop computer to a port replicator as well as for other computer applications.

SUMMARY OF THE INVENTION

This need is met by the invention of the present application wherein an extender card is formed from first and second plastic clamshell halves which are intermated with one another and ultrasonically welded. The first clamshell half is sized to be received within an outer periphery of the second clamshell so that, once welded, the resulting extender card housing body is strong and attractive in that the weld is internal and hidden from view. A cable tie is secured to a cable extending from the extender card and received within a collar of the extender card housing body to provide strain relief for the cable. One or more apertures are formed through the extender card body to allow access to a PCMCIA card or PC card installed adjacent to the extender card, for example, to a modular jack receiving structure of a PC modem or network card.

In accordance with one aspect of the present invention, an extender card comprises a first plastic clamshell half having a first end and a second end, and a second plastic clamshell half having a first end and a second end. The first clamshell half mates with and is ultrasonically welded to the second clamshell half to form an extender card housing. The extender card includes a multiple pin connector mounted in the first ends of the first and second clamshell halves, and collar halves formed in the second ends of the first and second clamshell halves. The collar halves form a collar when the first and second clamshell halves are mated together for receiving a cable having multiple conductors coupled to the multiple pin connector. The multiple pin connector may comprise, for example, a 68-pin PCMCIA connector.

A printed circuit board having a first end connected to the multiple pin connector and a second end connected to the multiple conductors may be used to couple the multiple pin connector to the multiple conductors. The multiple pin connector preferably comprises a straddle mount connector with the first end of the printed circuit board having a first plurality of circuit paths on the first side of the printed circuit board, a second plurality of circuit paths on the second side of the printed circuit board, and being received in the straddle mount connector. In an illustrated embodiment, the second end of the printed circuit board has a third plurality of printed circuit paths on the second side thereof, the third plurality of circuit paths having a first portion thereof connected to the first plurality of circuit paths on the first side of the printed circuit board and a second portion thereof connected to the second plurality of circuit paths through the printed circuit board between the first end of the printed circuit board and the second end of the printed circuit board.

For cable strain relief, the interior of the collar defines a recess for receiving a cable tie secured to the cable at the second ends of the first and second clamshell halves. The recess comprises a generally annular recess with a cavity formed in one of the first and second clamshell halves for receiving a head of the cable tie. The first clamshell half may include a periphery which is sized to be received within a periphery of the second clamshell half so that an ultrasonic weld securing the first and second clamshell halves to one another is substantially hidden from view. For this embodiment, the periphery of the second clamshell half defines a shoulder extending away from the second clamshell half and the first clamshell half defines an outer peripheral edge which faces the shoulder when the first and second clamshell halves are mated with one another. The second clamshell half further defines a channel extending into the first clamshell half juxtaposed the shoulder and the first clamshell half defines a rib juxtaposed the outer peripheral edge, the rib being spaced and sized to be received within the channel when the first and second clamshell halves are mated with one another. The rib includes a plurality of projections thereon, the projections engaging a bottom of the channel when the first and second clamshell halves are mated with one another and defining ultrasonic energy directors.

The extender card may be a PCMCIA extender card designed to be received within a first PCMCIA slot of a computer. The extender card may include at least one aperture to enable access to a PCMCIA card received within a second PCMCIA slot of a computer. At least one aperture is particularly advantageous where the PCMCIA card in a second slot includes structure for receiving a terminal connector at the end of a transmission media which extends beyond the PCMCIA card and the at least one aperture is aligned with the structure for receiving a terminal connector at the end of a transmission media. Preferably, the extender card includes two apertures on opposite sides of a centerline of the extender card.

In accordance with another aspect of the present invention, apparatus for cable strain relief comprises a first cable receiving collar half formed in a first housing body half and a second cable receiving collar half formed in a second housing body half. The first and second body halves are mated with one another to form a housing having a cable receiving collar. A generally annular recess is formed on inside surfaces of the first and second collar halves for receiving a cable tie secured to a cable received within the collar and a cavity is formed in one of the first and second collar halves for receiving a head of the cable tie. The housing may comprise a housing for a PCMCIA extender card.

In accordance with yet another aspect of the present invention, apparatus for cable strain relief comprises a first portion of a cable receiving collar and a second portion of a cable receiving collar with the first and second portions of the cable receiving collar being secured to one another to form a cable receiving collar. A first recess is formed on an insider surface of the first portion of the cable receiving collar, the first recess being formed to receive a portion of a cable tie secured to a cable to be received by the collar. And a second recess is formed on an insider surface of the second portion of a cable receiving collar, the second recess being formed to receive a portion of the cable tie. Preferably, the cable tie includes a head and the apparatus for cable strain relief further comprises a cavity formed on the inside surface of one of the first and second portions of a cable receiving collar, the cavity being sized to receive the head of the cable tie.

In accordance with still another aspect of the present invention, a PCMCIA extender card comprises a housing having a first end and a second end with a PCMCIA connector mounted in the first end of the housing. The second end of the housing extends beyond the outer surface of a computer when the first end of the housing is inserted into a first PCMCIA slot of the computer. At least one aperture extends entirely through the housing to permit access to a PCMCIA card inserted into a second PCMCIA slot of the computer. Preferably, two apertures extend entirely through the housing on opposite sides of a centerline of the PCMCIA extender card.

It is an object of the present invention to provide an improved extender card for use with computers wherein the extender card is formed by intermating two plastic clamshell halves with one another and ultrasonically welding the clamshell halves together to form a housing body for the extender card; to provide an improved extender card for use with computers wherein the extender card is formed by intermating two plastic clamshell halves such that an ultrasonic weld securing the two together provides a strong weld which is hidden from view; to provide an improved PCMCIA extender card for use with computers wherein the extender card permits other PCMCIA cards or PC cards to be used in a PCMCIA slot adjacent to the one which is occupied by the extender card; to provide an improved extender card for use with computers wherein the extender card includes an inexpensive cable strain relief arrangement; and, to provide an improved extender card for use with computers wherein the extender card includes an inexpensive cable strain relief arrangement comprising a cable tie which is securely received within a collar of the extender card.

Other objects and advantages of the invention will be apparent from the following description, the accompanying drawings and the appended claims.

BRIEF DESCRIPTION OF THE DRAWINGS

FIG. 6 is a broken-away perspective view of a second or cable receiving end of the extender card of FIG. 1 showing a strain relief arrangement of the present invention for a cable of the extender card;

FIG. 7 is a perspective view of an end of the cable of FIG. 6 showing a cable tie which forms a part of the strain relief arrangement;

FIG. 8 is a partially sectioned side view of a cable receiving collar of the extender card of FIG. 1 showing the cable strain relief arrangement of the present invention;

DETAILED DESCRIPTION OF THE INVENTION

The present invention generally relates to extender cards for computers, however, it will be described herein with reference to a PCMCIA (Personal Computer Memory Card International Association) extender card for which it is initially being used. The described PCMCIA extender card provides access to a laptop computer having a PCMCIA slot for port replication through the PCMCIA slot.

Figure 1:
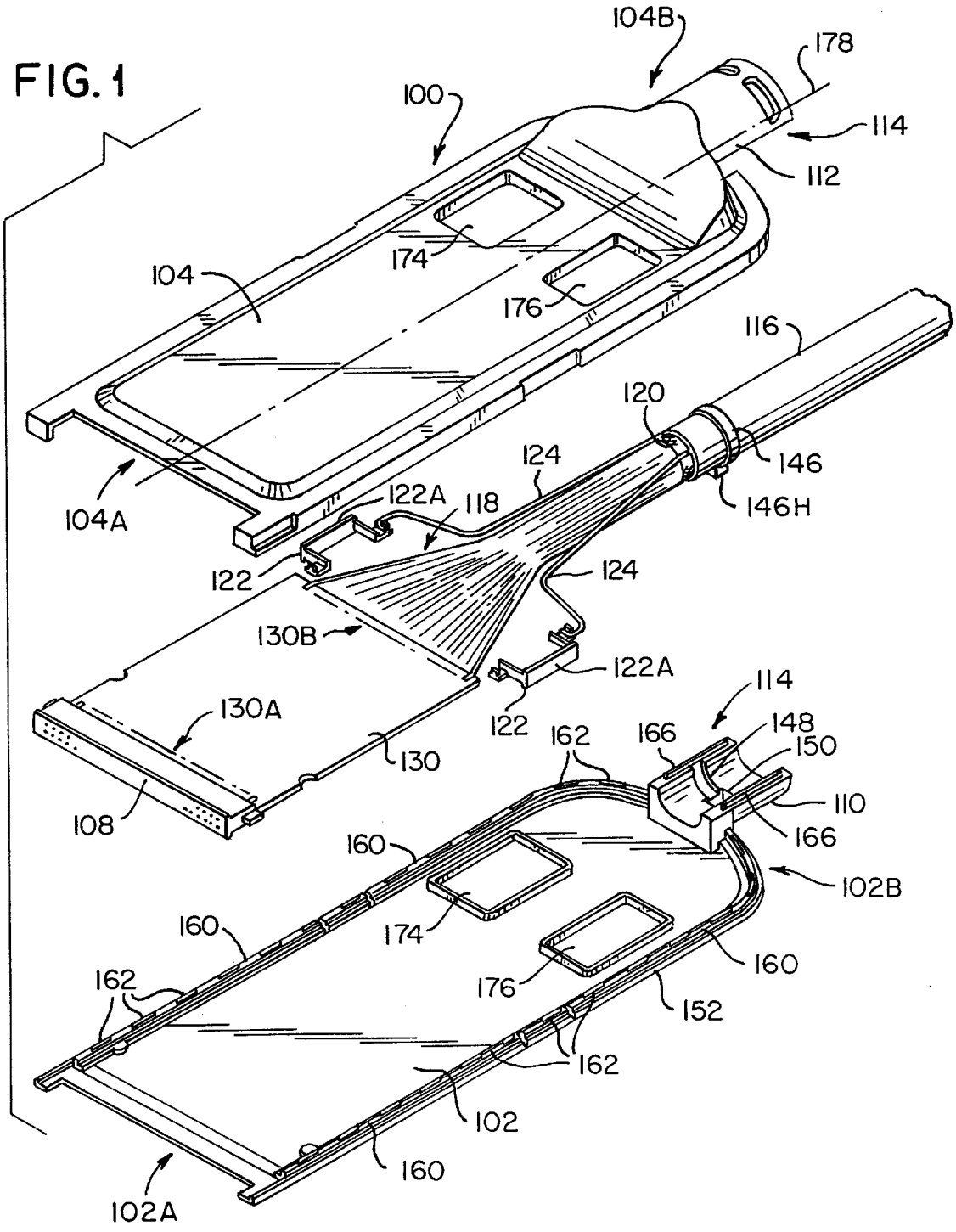
FIG. 1 is an exploded perspective view of a PCMCIA extender card in accordance with the present invention.
Figure 5:
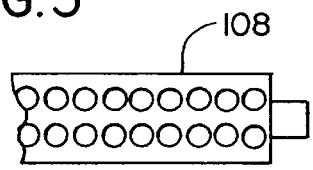
FIG. 5 is a broken-away front view of a portion of the straddle mount connector showing pin openings.

Reference will now be made to the drawing figures wherein FIG. 1 shows an exploded view of a PCMCIA extender card 100 in accordance with the present invention. The extender card 100 comprises a first clamshell half 102 having a first end 102A and a second end 102B; and, a second clamshell half 104 having a first end 104A and a second end 104B. The first clamshell half 102 mates with and is ultrasonically welded to the second clamshell half 104 to form an extender card housing 106, see FIG. 8. A multiple pin connector 108 is mounted in the first ends 102A, 104A of the first and second clamshell halves 102, 104. As illustrated, the multiple pin connector 108 comprises a 68-pin PCMCIA straddle mount connector commercially available from a number of suppliers including Berg, JAE, JST and Foxconn, see also FIGS. 2 and 5; however, other 68-pin PCMCIA connectors, PCMCIA connectors having less than 68 pins and other connectors also can be used in the present invention as required for specific applications.

Figures 9, 10, 11, 12, 13:
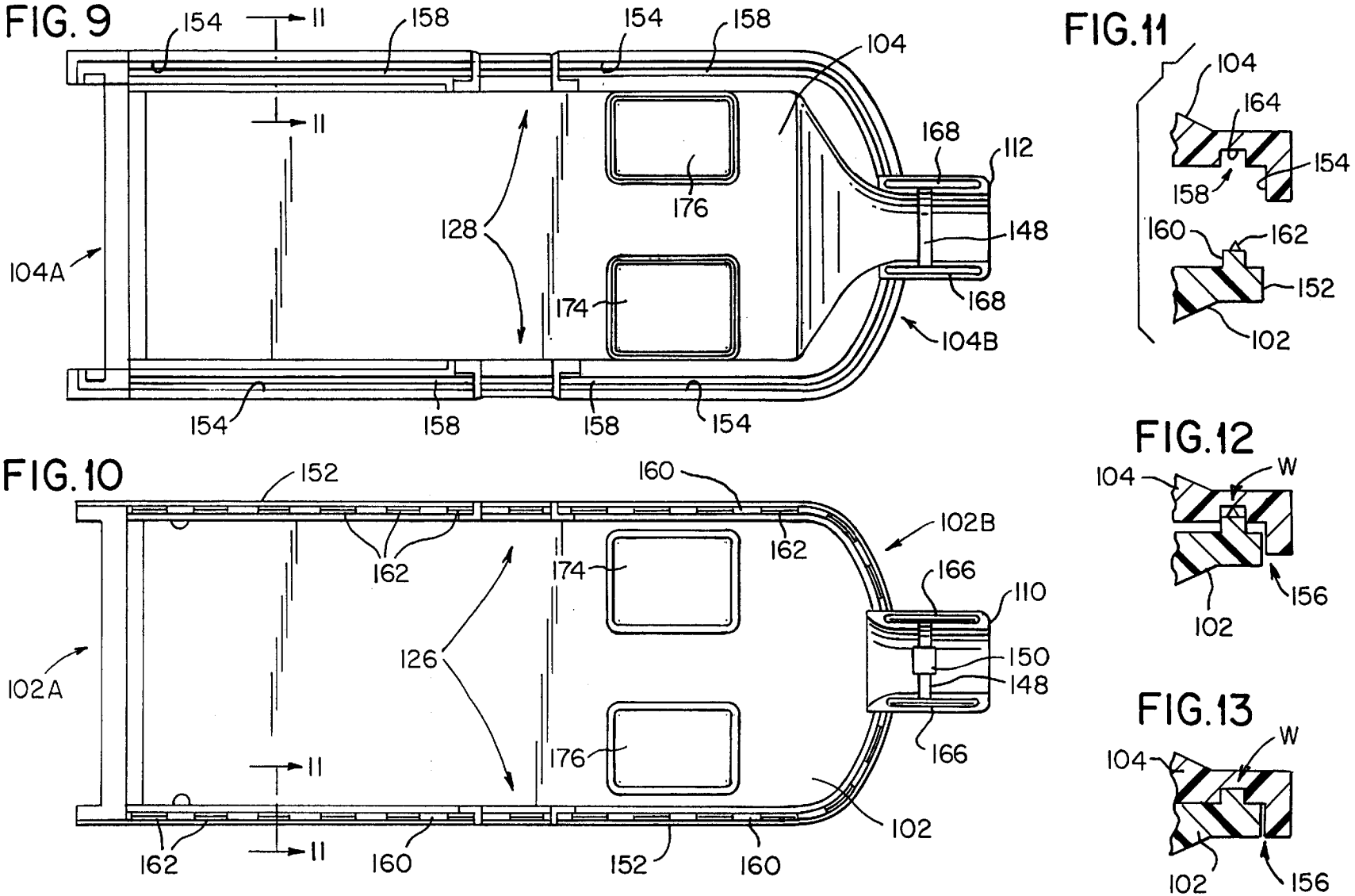
FIG. 9 is a plan view of the interior of a lower or first clamshell half as illustrated in FIG. 1.
FIG. 10 is a plan view of the interior of an upper or second clamshell half as illustrated in FIG. 1.
FIGS. 11–12 are sectional views through a peripheral edge of the first and second clamshell halves as they are mated together prior to being ultrasonically welded illustrating intermating surfaces which enable an ultrasonic weld to be formed which is strong and is hidden from view.
FIG. 13 is a sectional view through a peripheral edge of the first and second clamshell halves after they have been mated together and ultrasonically welded to one another.
Figure 14:
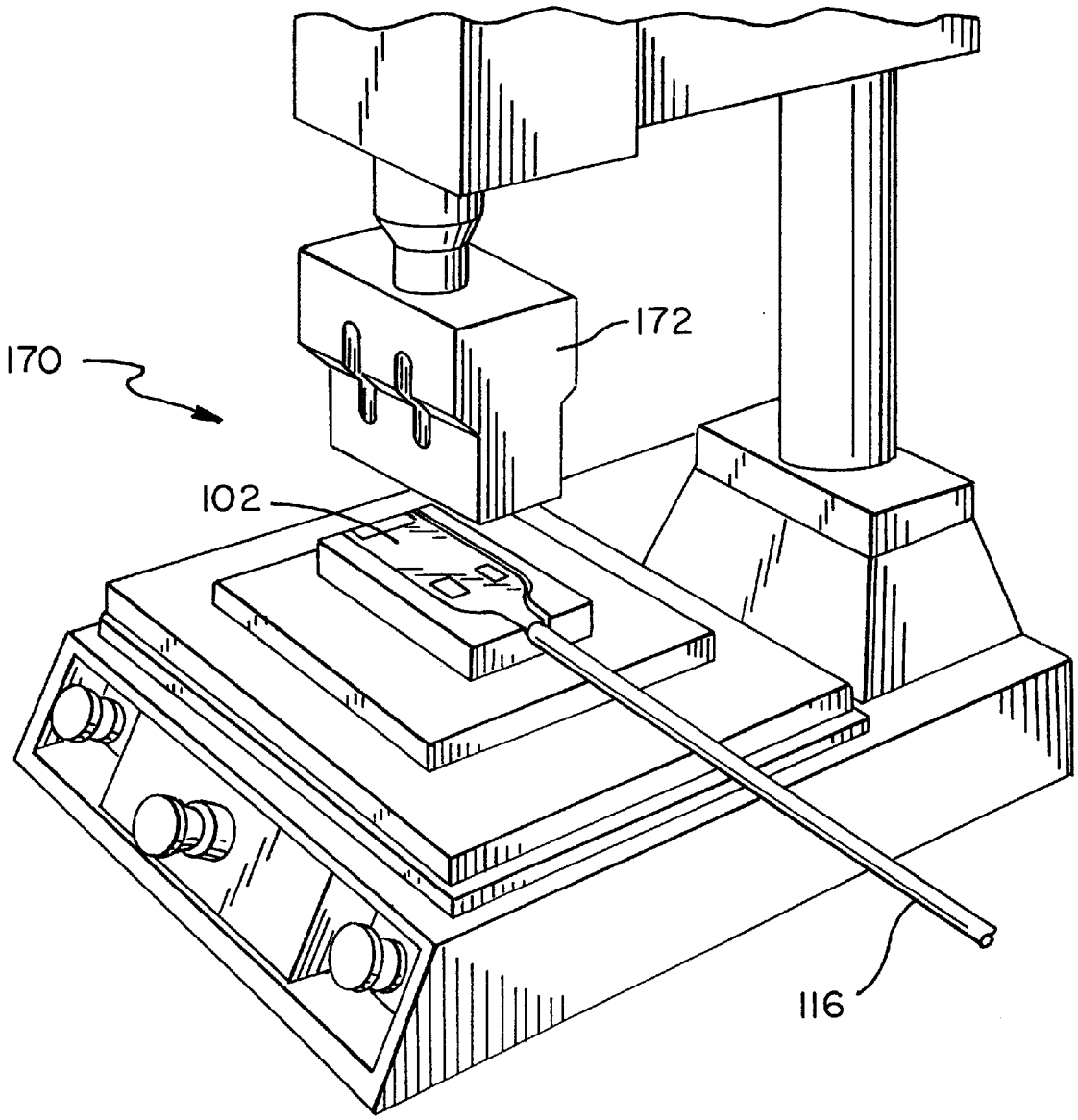
FIG. 14 is a perspective view of an ultrasonic welding machine used to assemble the PCMCIA extender card of FIG. 1.

First and second collar halves 110, 112 are formed in the second ends 102B, 104B of the first and second clamshell halves 102,104 with the collar halves 110, 112 forming a collar 114 when the first and second clamshell halves 102,104 are mated together, see FIGS. 1 and 8. The collar 114 receives a cable 116 having multiple conductors 118 coupled to the multiple pin connector 108. The cable 116 includes a grounding shield 120 to which two grounding clips 122 are electrically connected by wires 124. The grounding clips 122 are mounted within grounding clip receiving portions 126, 128 of the first and second clamshell halves 102,104 so that grounding faces 122A of the grounding clips 122 extend outside the card housing 106 for connection within a PCMCIA slot of a computer into which the extender card 100 is inserted, see FIGS. 1, 9 and 10.

Figure 2:
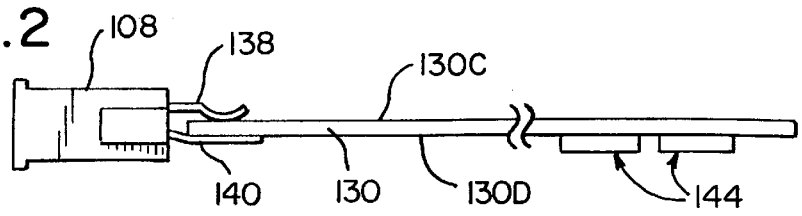
FIG. 2 is a side view of a straddle mount connector at a first end of the extender card of FIG. 1 on an expanded scale and engaged with a printed circuit board.
Figure 3:
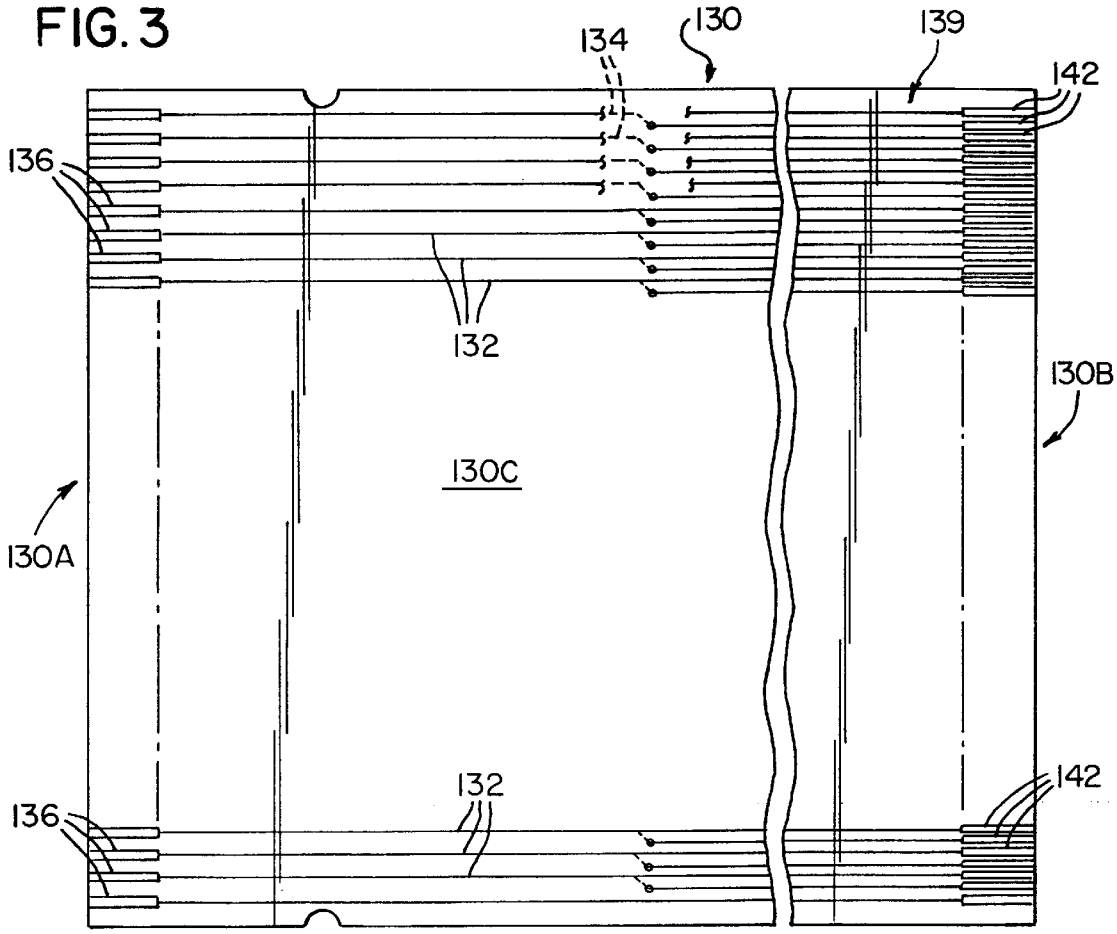
FIG. 3 is a plan view of the printed circuit board of FIGS. 1 and 2 on an expanded scale illustrating connection pads and through connects for connecting a plurality of conductors on a second side of the printed circuit board to a first side of the printed circuit board.
Figure 4:
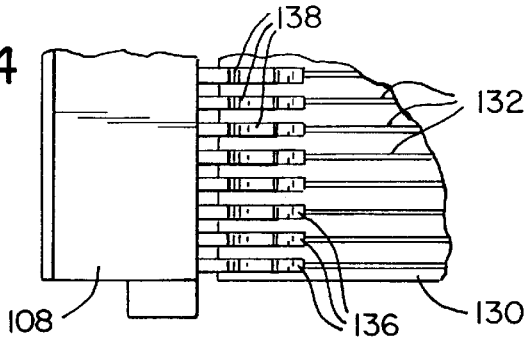
FIG. 4 is a broken-away plan view of a portion of FIG. 2 illustrating connecting fingers of the straddle mount connector engaging connecting pads of the printed circuit board.

In the illustrated embodiment, a printed circuit board 130 having a first end 130A and a second end 130B is provided to couple the multiple conductors 118 of the cable 116 to the multiple pin connector 108. The illustrated embodiment of the printed circuit board 130 has a top or first side 130C, as illustrated in FIGS. 2 and 3, and a second or bottom side 130D. The first end 130A of the printed circuit board 130 has a first plurality of circuit paths 132 (thirty four (34) circuit paths for the illustrated PCMCIA straddle mount connector) on the first side 130C of the printed circuit board 130 and a second plurality of circuit paths 134 (thirty four (34) circuit paths for the illustrated PCMCIA straddle mount connector) on the second side 130D of the printed circuit board 130. The printed circuit paths 132, 134 terminate in connection pads 136 on the first and second sides 130C, 130D of the printed circuit board 130 and are received in connecting fingers 138, 140 of the straddle mount multiple pin connector 108, see FIG. 2. Thus, the connection pads 136 are engaged by connecting fingers 138,140 extending from the connector 108 and soldered or otherwise electrically connected thereto.

The second end 130B of the printed circuit board 130 has a third plurality of printed circuit paths 139, sixty eight (68) circuit paths for the illustrated embodiment, on the first side 130C thereof. The third plurality of circuit paths 139 have a first portion thereof connected to the first plurality of circuit paths 132 on the first side 134C of the printed circuit board 130 and a second portion thereof connected to the second plurality of circuit paths 134 through the printed circuit board 130 between the first end 130A of the printed circuit board 130 and the second end 130B of the printed circuit board 130. The multiple conductors 118 of the cable 116 are fanned out and connected to connection pads 142 to which the third plurality of circuit paths 138 are connected.

While this arrangement provides a quick, convenient and inexpensive arrangement for interconnecting the multiple conductors 118 of the cable 116 to the multiple pin connector 108, other connection arrangements are contemplated in the present invention. For example, 34 circuit paths can be provided along the entire length of each side of a printed circuit board with straddle mount like connections made at each end; the multiple conductors 118 of the cable 116 can be connected to opposite sides of a printed circuit board with all 68 circuit paths being connected to a PCMCIA connector on one side of the printed circuit board; and, the printed circuit board can be reduced in size. Other connection arrangements will be apparent to those skilled in the art from this disclosure. The circuit board 130 can also be configured to accept components 144 on one or both sides thereof so that an original equipment manufacturer (OEM) can put desired circuitry on the board. Of course the types of circuitry can vary widely depending upon a particular OEM's requirements. However, for example, an OEM may provide modem circuitry, signal processing circuitry or other appropriate circuitry on the circuit board to meet its specific requirements.

Reference will now be made to FIGS. 1 and 6–8 which illustrate cable strain relief apparatus of the present invention. With the cable 116 extending from the extender card housing 106, one may pull on the cable 116 to remove the extender card 100 from a PCMCIA slot of a computer to which it is inserted. If not otherwise restrained, for example by the cable strain relief apparatus illustrated in FIGS. 1 and 6–8, the cable 116 can slip in the collar 114 resulting in possible disconnection of the multiple conductors 118 from the printed circuit board 130. To prevent this from happening in the present invention, a cable tie 146 having a head 146H is securely attached to the cable 116. The cable tie 146 can be any one of a number of commercially available ties, for example a locking cable tie part number PLT.6SM-C commercially available from PANDUIT was used in a working embodiment of the present invention.

A first portion of a cable receiving collar is formed in a first housing body portion and a second portion of a cable receiving collar is formed in a second housing body portion. In the illustrated embodiment, the portions are halves and the collar halves 110, 112 form the collar 114 when the first and second clamshell halves 102, 104 are assembled to form the extender card housing 106 or housing body. A generally annular recess 148 is formed on inside surfaces of the first and second collar halves 110, 112 for receiving the cable tie 146 secured to the cable 116 and received within the collar 114. As illustrated, a cavity 150 is formed in the first collar half 110 for receiving the head 146H of the cable tie 146 thereby securely retaining the cable 116 within the collar 114 and hence to the extender card 100.

Reference will now be made to FIGS. 11–14 which illustrate the size relationship between the first and second clamshell halves 102, 104 and the ultrasonic welding operation performed to secure the first and second clamshell halves 102, 104 to one another with a weld which is strong and is hidden or substantially hidden from view. The first clamshell half 102 includes a periphery 152 which is sized to be received within a periphery 154 of the second clamshell half 104 so that an ultrasonic weld securing the first and second clamshell halves 102, 104 to one another is internal and hence hidden or substantially hidden from view. In particular, the periphery 154 of the second clamshell half 104 defines a shoulder extending away from the second clamshell half 104 (out of the page in FIG. 9) and the outer edge of the periphery 152 of the first clamshell half 102 faces the shoulder when the first and second clamshell halves 102, 104 are mated together so that the seam 156 between the two is beneath the extender card 100 and out of view.

The second clamshell half 104 further defines a channel 158 extending into the first clamshell half 104 juxtaposed the shoulder and the first clamshell half 102 defines a rib 160 juxtaposed the outer edge of the periphery 152, see FIGS. 9–13. The rib 160 is spaced and sized to be received within the channel 158 when the first and second clamshell halves 102, 104 are mated with one another. A plurality of projections 162 on the rib 160 engage a bottom 164 of the channel 158 when the first and second clamshell halves 102, 104 are mated together. The projections 162 define ultrasonic energy directors such that ultrasonic energy is directed to the projections 162 melting the projections 162 and adjacent portions of the bottom 164 of the channel 158 resulting in fusing or welding of the first and second clamshell halves 102,104 in the areas W of the projections 162.

Ultrasonic energy also welds the first and second collar halves 110, 112 to one another at ribs 166 formed on the first collar half 1 10 which ribs are received into slots 168 formed on the second collar half 112. The first and second clamshells 102, 104 are formed of an appropriate plastic material, ABS (acrylonitrile butadiene styrene resin) being used in a working embodiment of the present invention, with ultrasonic welding being performed using an ultrasonic welding machine 170 illustrated in FIG. 14 commercially available from Branson and including a horn 172 designed to provide ultrasonic energy to the areas of the first and second clamshells halves 102, 104 where they are to be welded. This results in a strong weld and structure for the extender card 100 which weld is hidden or substantially hidden from view.

Figure 15:
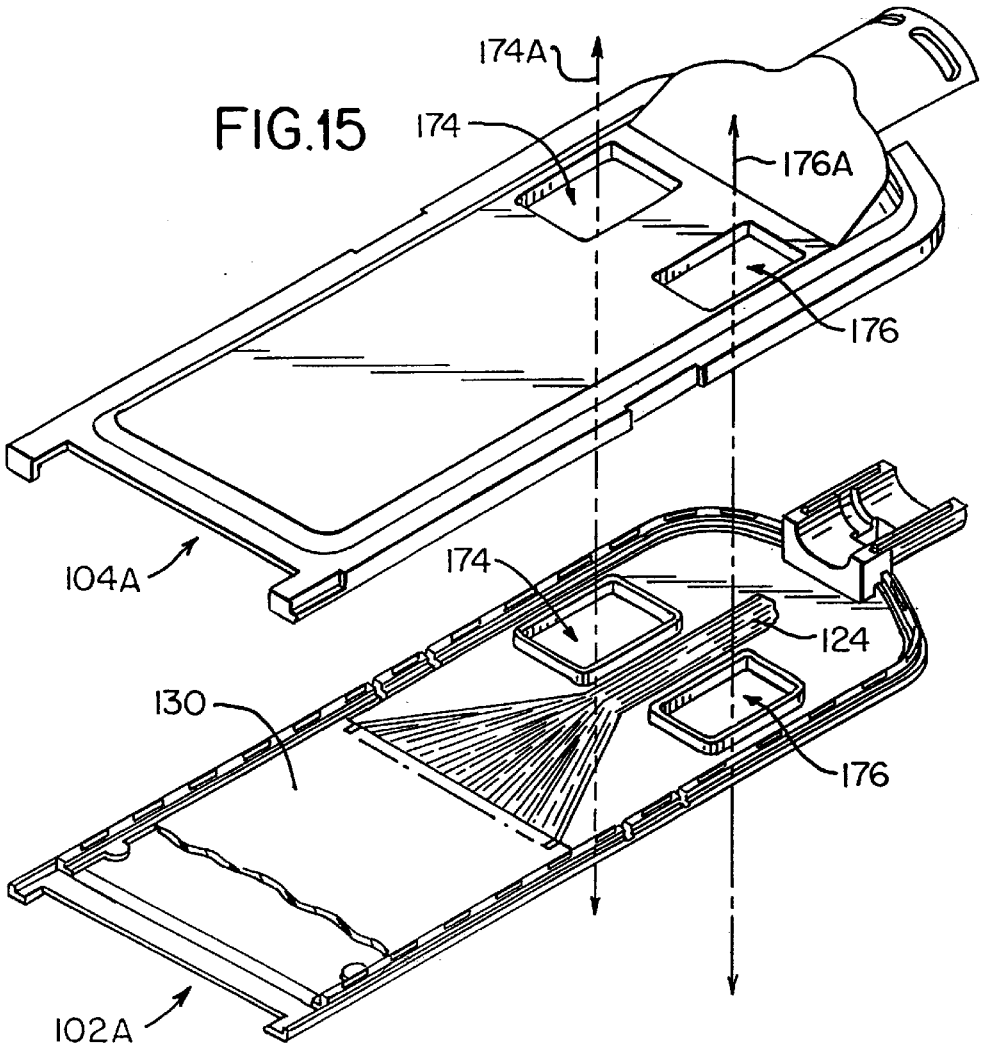
FIG. 15 is a perspective view of a PCMCIA extender card in accordance with the present invention illustrating apertures extending through the card body; and, FIG. 16 is a partially sectioned side view of a computer having first and second PCMCIA slots, where the extender card of FIG. 1 is inserted into the first PCMCIA slot, a second PCMCIA card inserted into the second PCMCIA slot, and a cable passes through the extender card and inserts into the second PCMCIA card.
Figure 16:
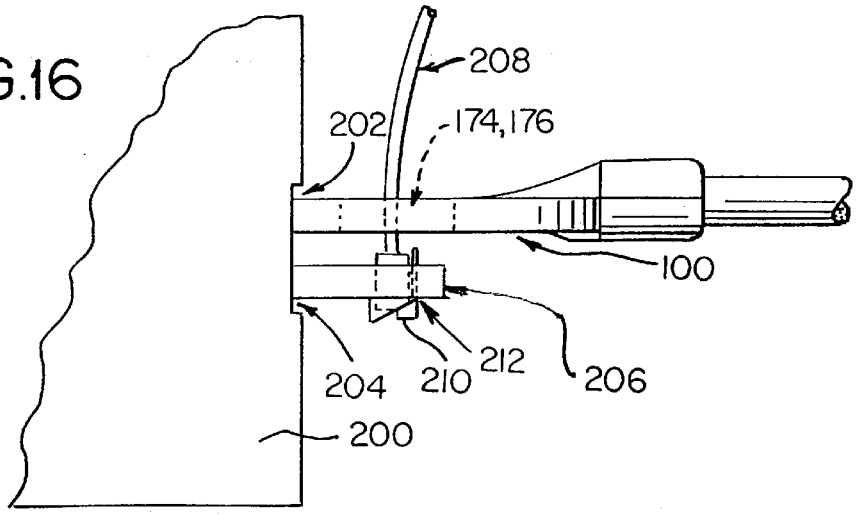

Referring to FIGS. 15 and 16, the PCMCIA extender card 100 is designed to be fitted within a first Type II PCMCIA slot 202, of two adjacent Type II PCMCIA slots 202, 204 commonly provided on laptop computers 200. Accordingly, another PCMCIA card or PC card 206 can be inserted into the second Type II PCMCIA slot 204, of the two Type II PCMCIA slots 202, 204. To increase the variety of PCMCIA cards 206 which can be inserted adjacent to the extender card 100, at least one aperture is provided in the extender card 100, with two apertures 174, 176 being provided on opposite sides of a centerline 178 of the extender card 100 in the illustrated embodiment, see FIG. 1. The aperture or apertures 174, 176 enable access to a PCMCIA card 206 received within the second Type II PCMCIA slot 204 of the computer 200. More particularly, where the PCMCIA card 206 is a network or modem card for example, and is inserted into the second Type II PCMCIA slot 204 of a computer 200, structure 212 is provided for receiving a terminal connector 210, for example a standard RJ-11 or an RJ-45 modular plug, at the end of a transmission media 208. The structure 212, as illustrated for example in U.S. Pat. No. 5,876,218 which is incorporated by reference herein or as represented by X-jacks on modems commercially available from 3Com corporation, extends beyond the end of the PCMCIA card 206 for access. An appropriate modular plug 210 is connected to the structure 212 through one or the other of the apertures 174, 176 which are positioned to be aligned with the structure 212. Since the apertures 174, 176 extend entirely through the extender card 100 along axis 174A and 176A respectively, the extender card 100 can be used in either of the two Type II PCMCIA slots 202, 204.

Having thus described the invention of the present application in detail and by reference to preferred embodiments thereof, it will be apparent that modifications and variations are possible without departing from the scope of the invention defined in the appended claims.

What is claimed is:

1. An extender card comprising:

a first plastic clamshell half having a first end and a second end;

a second plastic clamshell half having a first end and a second end, said second plastic clamshell half superposed on said first plastic clamshell half;

a multiple pin connector mounted in said first ends of said first and second clamshell halves;

collar halves formed in said second ends of said first and second clamshell halves, said collar halves forming a collar when said first and second clamshell halves are mated together;

a cable having multiple conductors extending through said collar halves in said second ends of said first and second clamshell halves; and, a printed circuit board having first and second sides with a first end of said printed circuit board being connected to said multiple pin connector and a second end of said printed circuit board being connected to said multiple conductors thereby coupling said multiple pin connector to said multiple conductors;

wherein said first clamshell half is mated with and ultrasonically welded to said second clamshell half to form an extender card housing.

2. An extender card as claimed in claim 1 wherein said multiple pin connector comprises a 68-pin PCMCIA connector.

3. An extender card as claimed in claim 1, wherein said first end of said printed circuit board has a first plurality of circuit paths on said first side of said printed circuit board, a second plurality of circuit paths on said second side of said printed circuit board, and being received in said multiple Din connector.

4. An extender card as claimed in claim 3 wherein said second end of said printed circuit board has a third plurality of printed circuit paths on said second side thereof, said third plurality of circuit paths having a first portion thereof connected to said first plurality of circuit paths on said first side of said printed circuit board and a second portion thereof connected to said second plurality of circuit paths through said printed circuit board between said first end of said printed circuit board and said second end of said printed circuit board.

5. An extender card as claimed in claim 1 wherein an interior of said collar defines a recess for receiving a cable tie secured to said cable for providing strain relief for said cable at said second ends of said first and second clamshell halves.

6. An extender card as claimed in claim 5 wherein said recess comprises a generally annular recess with a cavity formed in one of said first and second clamshell halves for receiving a head of said cable tie.

7. An extender card as claimed in claim 1 wherein said first clamshell half includes a periphery which is sized to be received within a periphery of said second clamshell half.

8. An extender card as claimed in claim 7 wherein said periphery of said second clamshell half defines a shoulder extending away from said second clamshell half and said first clamshell half defines an outer peripheral edge which faces said shoulder when said first and second clamshell halves are mated with one another.

9. An extender card as claimed in claim 8 wherein said second clamshell half further defines a channel extending into said first clamshell half juxtaposed said shoulder and said first clamshell half defines a rib juxtaposed said outer peripheral edge, said rib being spaced and sized to be received within said channel when said first and second clamshell halves are mated with one another.

10. An extender card as claimed in claim 9 wherein said rib includes a plurality of projections thereon, said projections engaging a bottom of said channel when said first and second clamshell halves are mated with one another.

11. An extender card as claimed in claim 10 wherein said projections define ultrasonic energy directors.

12. An extender card as claimed in claim 1 wherein said extender card is a PCMCIA extender card designed to be received within a first PCMCIA slot of a computer.

13. An extender card as claimed in claim 12 wherein said extender card includes at least one aperture extending entirely through said extender card, to enable access to a PCMCIA card received within a second PCMCIA slot of a computer.

14. An extender card as claimed in claim 13 wherein said PCMCIA card includes structure for receiving a terminal connector at the end of a transmission media which extends beyond said PCMCIA card and said at least one aperture is aligned with said structure for receiving a terminal connector at the end of a transmission media.

15. An extender card as claimed in claim 13 wherein said extender card includes two apertures, each extending entirely through said extender card, on opposite sides of a centerline of said extender card.

16. A PCMCIA extender card comprising:

a housing having a first end and a second end;

a PCMCIA connector mounted in said first end of said housing, said second end of said housing extending beyond the outer surface of a computer when said first end of said housing is inserted into a first PCMCIA slot of said computer; and at least one aperture extending entirely through said housing to permit access to a PCMCIA card inserted into a second PCMCIA slot of said computer.

17. A PCMCIA extender card as claimed in claim 16 comprising two apertures extending entirely through said housing on opposite sides of a centerline of said PCMCIA extender card.

18. A PCMCIA extender card as claimed in claim 16, wherein said housing further comprises a first plastic clamshell half having a first end and a second end, and a second plastic clamshell half having a first end and a second end, said second plastic clamshell half superposed on and ultrasonically welded to said first plastic clamshell half.

19. A PCMCIA extender card as claimed in claim 18, wherein said housing further comprises:

collar halves formed in said second ends of said first and second clamshell halves, said collar halves forming a collar when said first and second clamshell halves are mated together; and a cable having multiple conductors coupled to said PCMCIA connector at said first ends of said first and second clamshell halves, and extending through said collar halves in said second ends of said first and second clamshell halves.

20. A PCMCIA extender card as claimed in claim 16, further comprising multiple conductors, and a printed circuit board having first and second sides with a first end of said printed circuit board being connected to said PCMCIA connector and a second end of said printed circuit board being connected to said multiple conductors thereby coupling said PCMCIA connector to said multiple conductors.

21. A PCMCIA extender card as claimed in claim 19, wherein an interior of said collar defines a generally annular recess with a tie head receiving cavity formed in one of said first and second clamshell halves.

22. A PCMCIA extender card as claimed in claim 18, wherein:

said second clamshell half includes a second perimeter and a shoulder extending out from at least a portion of said second perimeter forming a side wall;

said shoulder having an inside surface and an outside surface, and, said first clamshell half includes a first outer peripheral edge;

wherein said second clamshell half is superposed on said first clamshell half such that said inside surface of said shoulder on said second clamshell half circumscribes and abuts said first outer peripheral edge.

23. A PCMCIA extender card as claimed in claim 22, wherein said second clamshell half further defines a channel extending into said second clamshell half juxtaposed said shoulder and said first clamshell half defines a rib juxtaposed said outer peripheral edge, said rib being spaced and sized to be received within said channel when said first and second clamshell halves are mated with one another.

24. An extender card comprising:

a first plastic clamshell half having a first end, a second end, and a first outer peripheral edge;

a second plastic clamshell half having a first end, a second end, a perimeter, and a shoulder extending out from at least a portion of said perimeter forming a side wall;

said shoulder having an inside surface and an outside surface;

a multiple pin connector mounted in said first ends of said first and second clamshell halves;

collar halves formed in said second ends of said first and second clamshell halves, said collar halves forming a collar when said first and second clamshell halves are mated together; and a cable having multiple conductors coupled to said multiple pin connector at said first ends of said first and second clamshell halves, and extending through said collar halves in said second ends of said first and second clamshell halves;

wherein said second clamshell half is superposed on said first clamshell half such that said inside surface of said shoulder on said second clamshell half circumscribes and abuts said first outer peripheral edge of said first clamshell half, and said first and second clamshell halves are ultrasonically welded to each other to form an extender card housing.

25. An extender card as claimed in claim 24 further comprising a printed circuit board having first and second sides with a first end of said printed circuit board being connected to said multiple pin connector and a second end of said printed circuit board being connected to said multiple conductors thereby coupling said multiple pin connector to said multiple conductors.

26. An extender card as claimed in claim 24 wherein an interior of said collar defines a generally annular recess with a cable tie receiving cavity formed in one of said first and second clamshell halves.

27. An extender card as claimed in claim 24 wherein said second clamshell half further defines a channel extending into said second clamshell half juxtaposed said shoulder and said first clamshell half defines a rib juxtaposed said outer peripheral edge, said rib being spaced and sized to be received within said channel when said first and second clamshell halves are mated with one another.

28. An extender card as claimed in claim 27 wherein said rib includes a plurality of projections thereon, said projections engaging a bottom of said channel when said first and second clamshell halves are mated with one another.

29. An extender card as claimed in claim 24 wherein said extender card includes at least one aperture extending entirely through said extender card to enable access to a second card through said extender card.

* * * * *

UNITED STATES PATENT AND TRADEMARK OFFICE

CERTIFICATE OF CORRECTION

PATENT NO. : 6,210,178 B1
DATED : April 3, 2001
INVENTOR(S) : Robert Duke DeForest, Jr.

It is certified that error appears in the above-identified patent and that said Letters Patent is hereby corrected as shown below:

Column 7,
Line 39, "half 1 10", should read -- half 110 --

Column 8,
Line 51, "multiple Din connector", should read -- multiple pin connector --

Signed and Sealed this

First Day of January, 2002

*Attest:*

*Attesting Officer*

JAMES E. ROGAN
*Director of the United States Patent and Trademark Office*